US008449169B2

(12) United States Patent
Maslowski et al.

(10) Patent No.: US 8,449,169 B2
(45) Date of Patent: May 28, 2013

(54) LED REPLACEMENT BULB FOR USE IN LOW EM ROOM

(75) Inventors: James P. Maslowski, Wauwatosa, WI (US); Elmer B. Woods, West Bend, WI (US); Matthew Boesel, Waterford, WI (US)

(73) Assignee: PDC Facilities, Inc., Hartland, WI (US)

( * ) Notice: Subject to any disclaimer, the term of this patent is extended or adjusted under 35 U.S.C. 154(b) by 0 days.

(21) Appl. No.: 13/351,665

(22) Filed: Jan. 17, 2012

(65) Prior Publication Data

US 2012/0182768 A1 Jul. 19, 2012

Related U.S. Application Data

(60) Provisional application No. 61/433,466, filed on Jan. 17, 2011.

(51) Int. Cl.
*H01R 33/00* (2006.01)

(52) U.S. Cl.
USPC ..... 362/646; 362/249.01; 362/249.02; 362/294; 362/311.02; 362/373; 362/640; 362/650

(58) Field of Classification Search
USPC ..... 362/249.01, 249.02, 640, 646, 800, 362/294, 311.02, 373, 650
See application file for complete search history.

(56) References Cited

U.S. PATENT DOCUMENTS

| | | | | |
|---|---|---|---|---|
| 7,758,223 | B2 * | 7/2010 | Osawa et al. | 362/547 |
| 2007/0041220 | A1 * | 2/2007 | Lynch | 362/646 |

* cited by examiner

*Primary Examiner* — Stephen F Husar
*Assistant Examiner* — Meghan Dunwiddie
(74) *Attorney, Agent, or Firm* — Joseph S. Heino; Patrick M. Bergin

(57) ABSTRACT

An LED replacement light bulb for use in a standard AC light bulb socket is provided. The light bulb includes a body, a heat sink portion and an end cap arranged to receive DC electrical current from the AC light bulb socket where the AC electrical system has been converted to a DC electrical system. The LED replacement bulb includes a base and wires connecting the base to a plurality of LEDs or to an LED board. A quick disconnect is disposed between the base and the plurality of LEDS or the LED board to allow for easy removal and replacement of the LEDs or of the LED board. In one preferred embodiment, a lens cover is provided with stand-off legs to avoid metal to metal contact between the bulb and its surrounding lighting fixture.

10 Claims, 7 Drawing Sheets

LED REPLACEMENT BULB FOR USE IN LOW EM ROOM

This application claims the benefit and priority of U.S. Provisional Patent Application No. 61/433,466 filed Jan. 17, 2011.

FIELD OF THE INVENTION

The present invention relates to light emitting diode (LED) light bulbs suitable for replacing incandescent bulbs. More particularly, the invention relates to an LED lighting system suited for use as a replacement for a conventional incandescent lighting system in a room that requires low electromagnetic (EM) emissions.

BACKGROUND OF THE INVENTION

Incandescent lights are being phased out of use and are being replaced with fluorescent bulbs, compact fluorescent bulbs, LED bulbs, and the like. In applications that use LED bulbs as replacements, electronics must be provided to convert the AC power supply that is typically available to DC.

A limitation of any electronics is that the electronics typically emit electromagnetic (EM) radiation that can interfere with other equipment. For example, LED replacements have not been an option in rooms requiring low EM emissions, such as magnetic resonance imaging (MRI) rooms or other low EM imaging rooms. The EM radiation is typically created by any metal to metal contact within such a room. Metal to metal contact can and does create white pixel artifacts that can impair the quality of the imaging results.

Accordingly, it is desirable to avoid metal to metal contact within such imaging rooms. It is also desirable to provide lighting devices and lighting systems in such imaging rooms where metal to metal contact is prevented, thereby eliminating unwanted EM radiation within such rooms.

SUMMARY OF THE INVENTION

In one embodiment, the present invention provides a system for replacing an incandescent lighting system with an LED based lighting system without producing unwanted EM radiation within the room.

In one construction, the invention provides a light bulb assembly for use in a standard AC light bulb socket. The light bulb includes a body defining an interior cavity, a heat sink portion and an end cap arranged to receive electrical current from the standard AC light bulb socket. A first wire harness includes a first plug and is coupled to the end cap to deliver the electrical current from the end cap directly to the first plug without substantial alteration of the current. A plurality of LEDs is removably coupled to the body. A second wiring harness includes a second plug and is coupled to each of the plurality of LEDs. The second plug is selectively connectable to the first plug to deliver the electrical current from the first plug to each of the plurality of LEDs without substantial alteration of the current.

In another construction, the invention provides a system for lighting a low EM room. The system includes a plurality of standard AC light bulb sockets disposed within the low EM room and a plurality of light bulbs. Each light bulb includes an end cap arranged to receive electrical current from the standard AC light bulb socket and a plurality of LEDs each electrically connected to the end cap to receive an electrical current that passes from the standard AC light bulb socket to the plurality of LEDs without substantial alteration of the electrical current. A power supply is disposed outside of the low EM room. The power supply is operable to convert an AC power supply to a DC electrical current and to deliver that DC electrical current as the electrical current to each of the plurality of standard AC light bulb sockets.

In yet another construction, the invention provides a light bulb assembly for use in a standard AC light bulb socket. The light bulb includes a body having a heat sink portion and an end cap arranged to receive electrical current from the standard AC light bulb socket. A plurality of LEDs is coupled to the body and an electrical circuit is coupled to each of the plurality of LEDs and to the end cap to deliver an electrical current from the end cap to each of the plurality of LEDs without substantial alteration of the current.

The foregoing and other features of the bulb and assembly of the present invention will be apparent from the following detailed description when read in conjunction with the accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, disconnects, supports, and couplings. Further, "connected" and "coupled" are not restricted to physical or mechanical connections or couplings.

Figure 1:
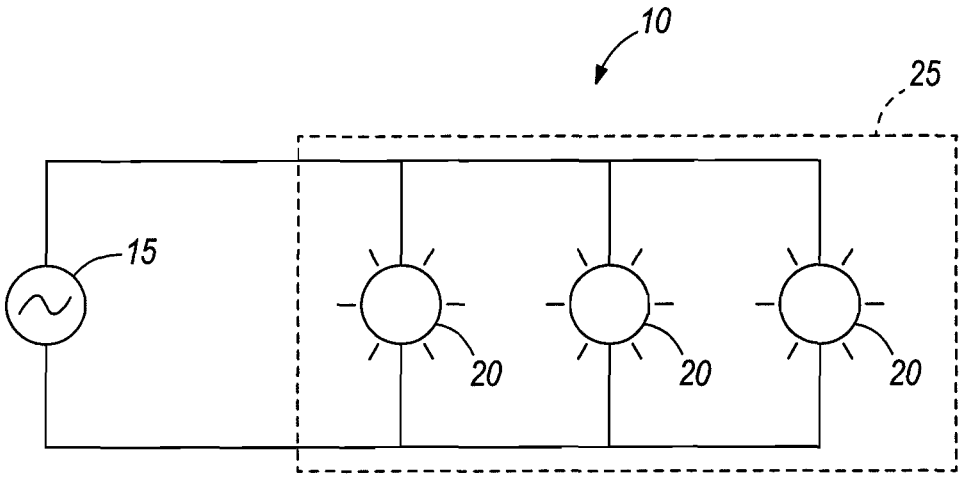
FIG. 1 is a schematic illustration of a typical AC lighting arrangement using incandescent light bulbs.

FIG. 1 schematically illustrates a simplified wiring diagram for a lighting system 10 for a room. As is well known, AC power is provided from a source 15 such as a utility grid, a stand-by generator, and the like and is provided to one or more lights 20 arranged in series or parallel. Dimmers, switches, and other control members (e.g., motion sensors, etc.) could also be positioned within the system 10 to control the light emitted by each or all of the lights 20. The illustrated system 10 could be employed to provide lighting in a room such as a magnetic resonance imaging (MRI) room 25. Typically, the lights 20 of FIG. 1 include incandescent light bulbs that provide the desired light quality and do not emit unwanted electromagnetic (EM) noise.

Incandescent light bulbs are being phased out to reduce electricity consumption and lighting costs in many facilities. The most popular replacements for incandescent light bulbs are fluorescent or compact fluorescent light bulbs or LED based light bulbs. However, these replacement bulbs can emit EM noise during operation that can interfere with an MRI scan.

Figure 2:
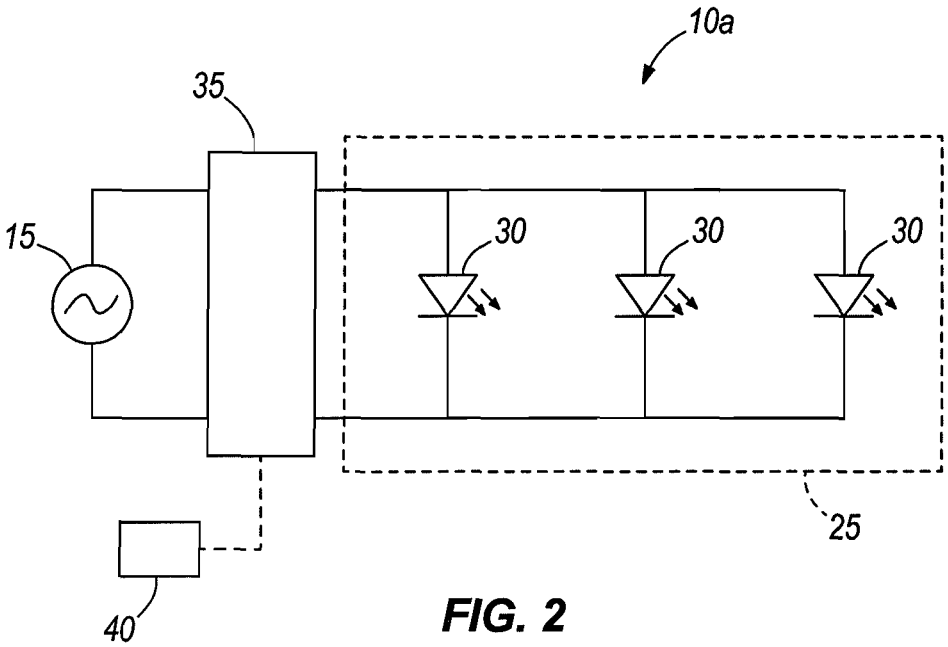
FIG. 2 is a schematic illustration of the lighting arrangement of FIG. 1 following a modification to accept LED replacement bulbs.
Figure 3:
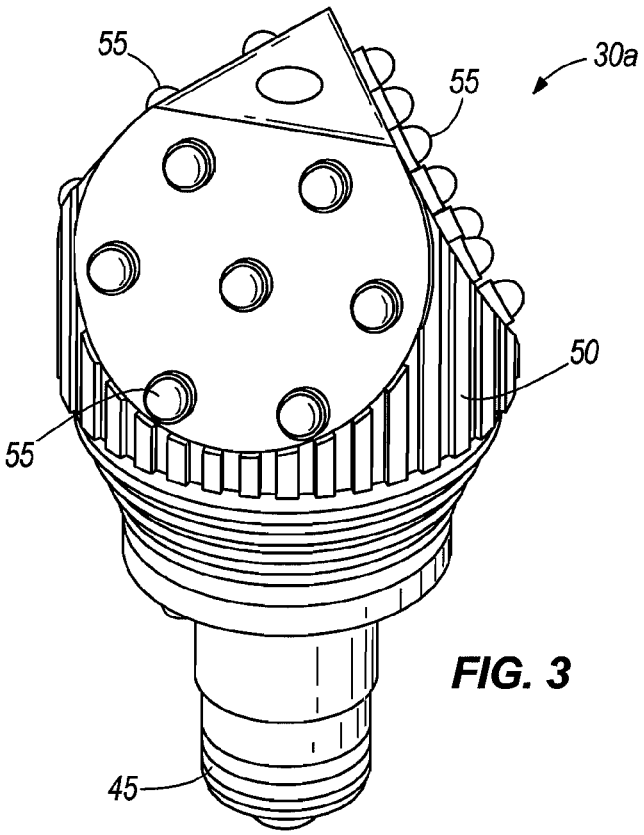
FIG. 3 is a perspective view of a replacement bulb including LEDs in accordance with the present invention.

FIG. 2 schematically illustrates a wiring diagram for the lighting system 10*a* of FIG. 1 following conversion to LED lights 30 using the present conversion system. The system 10*a* of FIG. 2 utilizes the same AC power source 15, much of the same wiring between the AC power source 15 and the lights 30, and the same light bulb sockets. In addition, many existing switches, dimmers, and the like can also be reused in the present system 10*a*.

A DC lighting controller 35 is positioned in the circuit of FIG. 2 to convert the AC power from the AC power source 15 to DC power suitable for use with the selected replacement LED bulbs 30. The DC lighting controller 35 includes a transformer that operates to convert the AC power to a suitable voltage for use with the LED bulbs and an AC to DC converter that converts the AC power to DC power. To inhibit unwanted EM noise from interfering with the MRI scan, the DC lighting controller 35 is positioned outside of the MRI room 25. In addition, EM shielding can be added to the DC lighting controller 35 to further reduce the likelihood of stray EM signals interfering with the MRI scan.

Thus, as illustrated in FIG. 2, the DC power from the DC lighting controller 35 flows to the lights 30 using the pre-existing wires. No replacement light sockets or new wires are required. In addition, a computer 40 can connect to the DC lighting controller 35 to better control the lights 30 if desired.

FIGS. 3-6 illustrate one possible replacement LED bulb 30*a* suitable for use in the system of FIG. 2. The replacement bulb 30*a* includes an electrically-conductive base 45, a body 50, and a plurality of LED elements 55 mounted in or attached to the body 50. The base 45 is sized and shaped to match a typical incandescent light bulb base to allow the base 45 to be received in a typical light bulb socket. In addition, the base provides the same electrical connections as the base of an incandescent light bulb to allow for the passage of electricity to the various LED elements 55.

The body 50 defines an outline that is similar to the outline of the globe of a typical incandescent light bulb. Thus, the LED bulb 30*a* is assured of fitting in the space provided for an incandescent light bulb.

Figure 4:
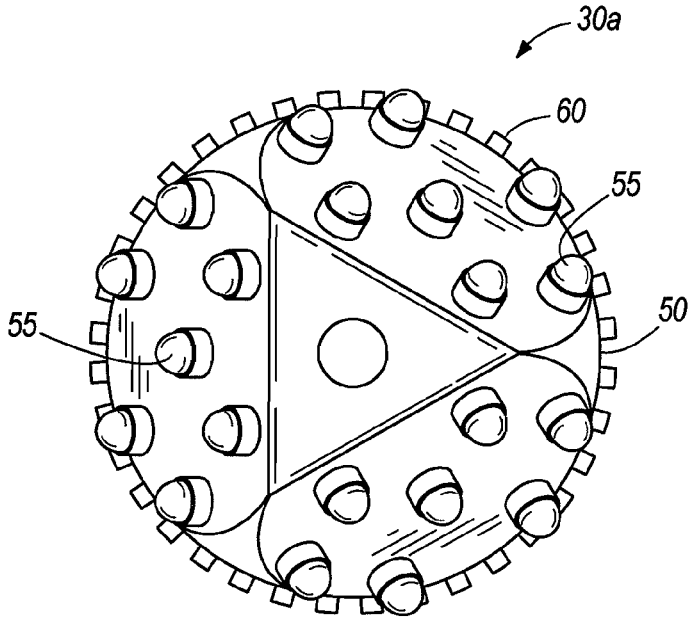
FIG. 4 is a top view of the replacement bulb of FIG. 3.
Figure 5:
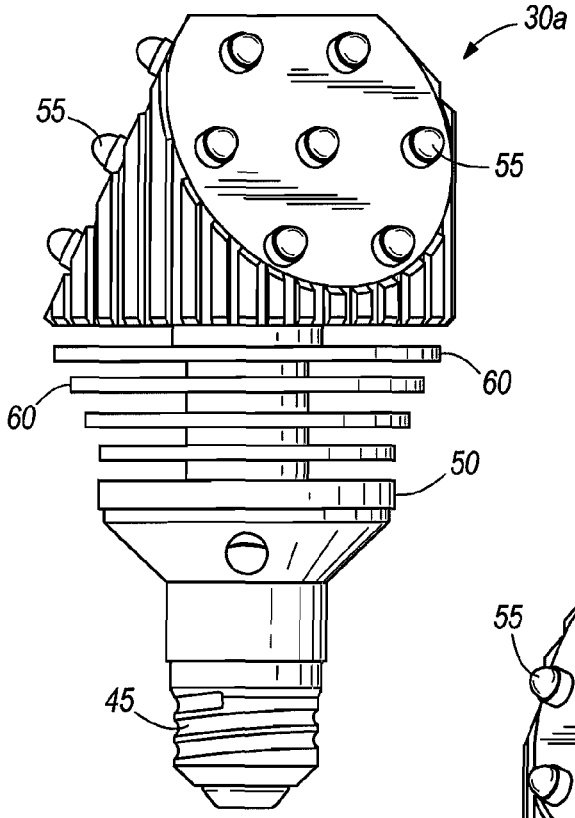
FIG. 5 is a first side view of the replacement bulb of FIG. 3.
Figure 6:
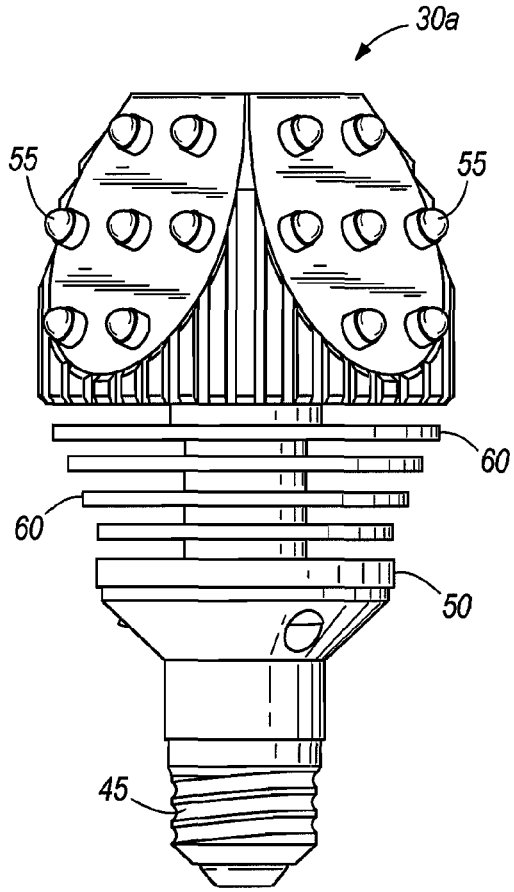
FIG. 6 is a second side view of the replacement bulb of FIG. 3.
Figure 7:
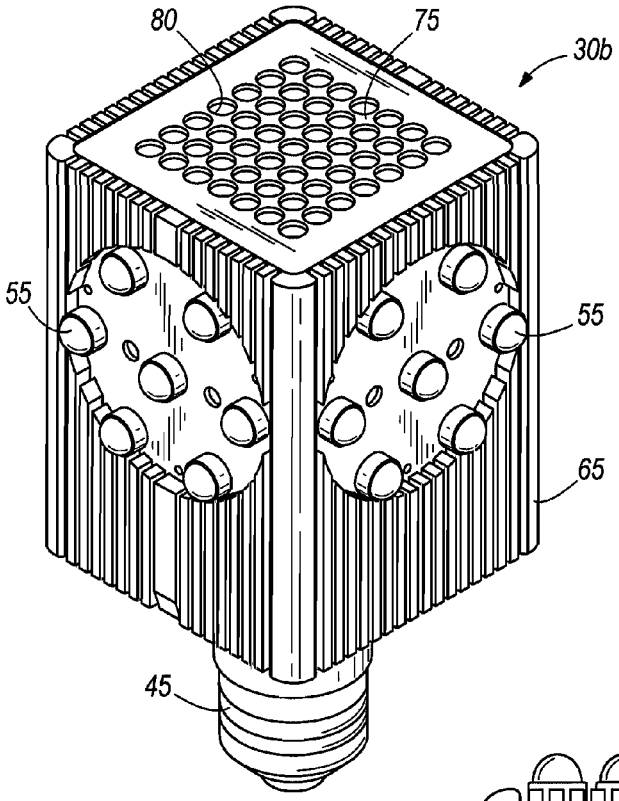
FIG. 7 is a perspective view of another replacement bulb including LEDs in accordance with the present invention.
Figure 8:
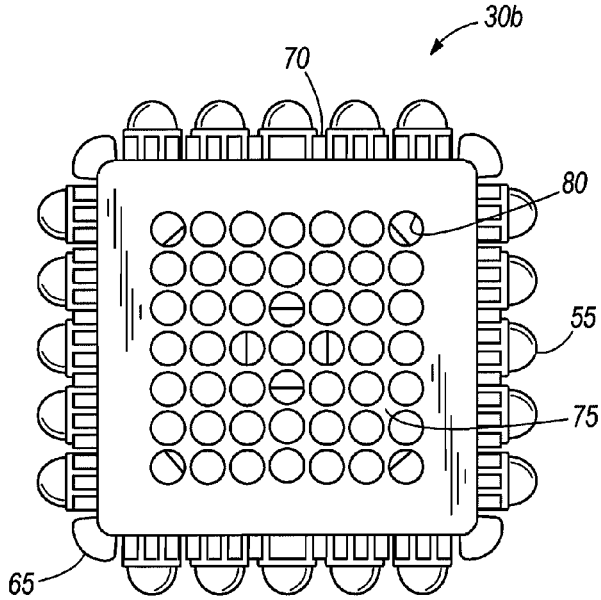
FIG. 8 is a top view of the replacement bulb of FIG. 7.
Figure 9:
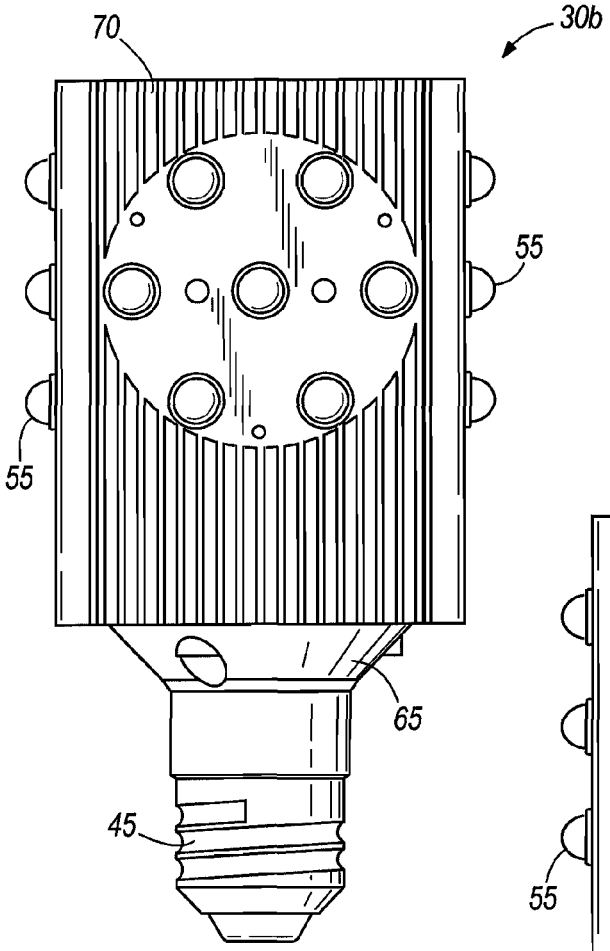
FIG. 9 is a first side view of the replacement bulb of FIG. 7.
Figure 10:
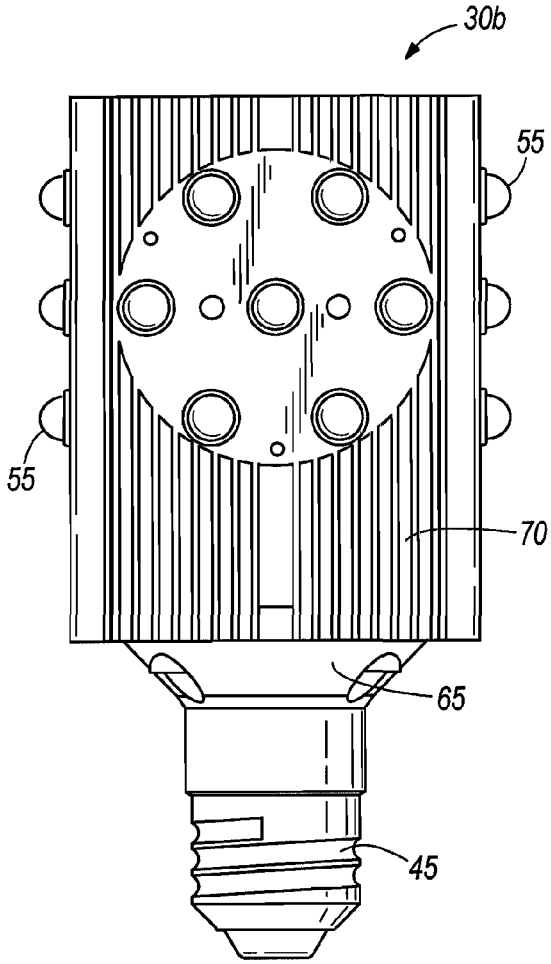
FIG. 10 is a second side view of the replacement bulb of FIG. 7.

In preferred constructions, the body 50 includes a heat conducting material such as aluminum to enhance the cooling ability of the body 50. In addition, as illustrated in FIGS. 4-6 the body 50 defines a plurality of fins 60 that further enhance the cooling ability of the body 50.

The LED elements 55 are mounted to the body 50 such that heat generated by the LED elements 55 during operation is conducted away from the LED 55 by the body 50. In preferred constructions, white LEDs 55 having a power output of about 1 watt are employed. However, other colors and sizes of LEDs 55 could be employed if desired and such is not a limitation of the present invention.

As discussed, the DC lighting controller 35 converts the AC power of the AC power supply 15 to DC electric power before the power is directed to the light sockets. Thus, the individual bulbs 30*a* of FIGS. 3-6 do not require any electronics to convert AC power to DC power.

FIGS. 7-10 illustrate another construction of a replacement LED light bulb 30*b* suitable for use in the system of FIG. 2. Like the replacement bulb 30*a* of FIGS. 3-6, the bulb 30*b* of FIGS. 7-10 includes a base 45, a body 65, and a plurality of LED elements 55 mounted to or embedded in the body 65. The base 45 is similar to the base 45 of the bulb 30*a* of FIGS. 3-6 as it is intended to be received in the same pre-existing sockets. In addition, the LED elements 55 are similar to those used in the bulb 30*a* of FIGS. 3-7 with other LED elements 55 also being suitable for use.

The body 65 is substantially hexahedron in shape and includes a plurality of ribs 70 that enhance cooling of the LED elements 55. In addition, the body 65 includes a central core 75 that includes a number of flow paths 80. Air can circulate through the flow paths 80 to further enhance cooling of the body 65 and the LED elements 55.

Figure 11:
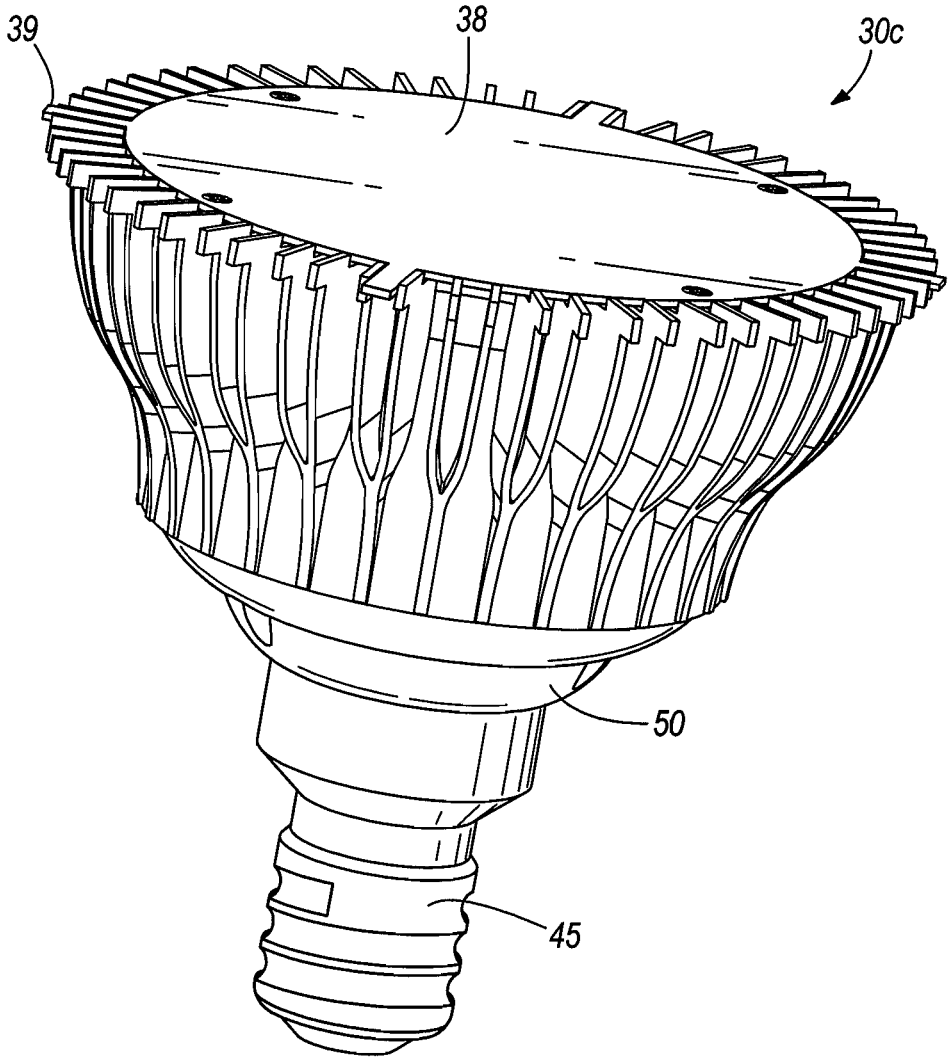
FIG. 11 is a perspective view of another replacement bulb including LEDs in accordance with the present invention.
Figure 12:
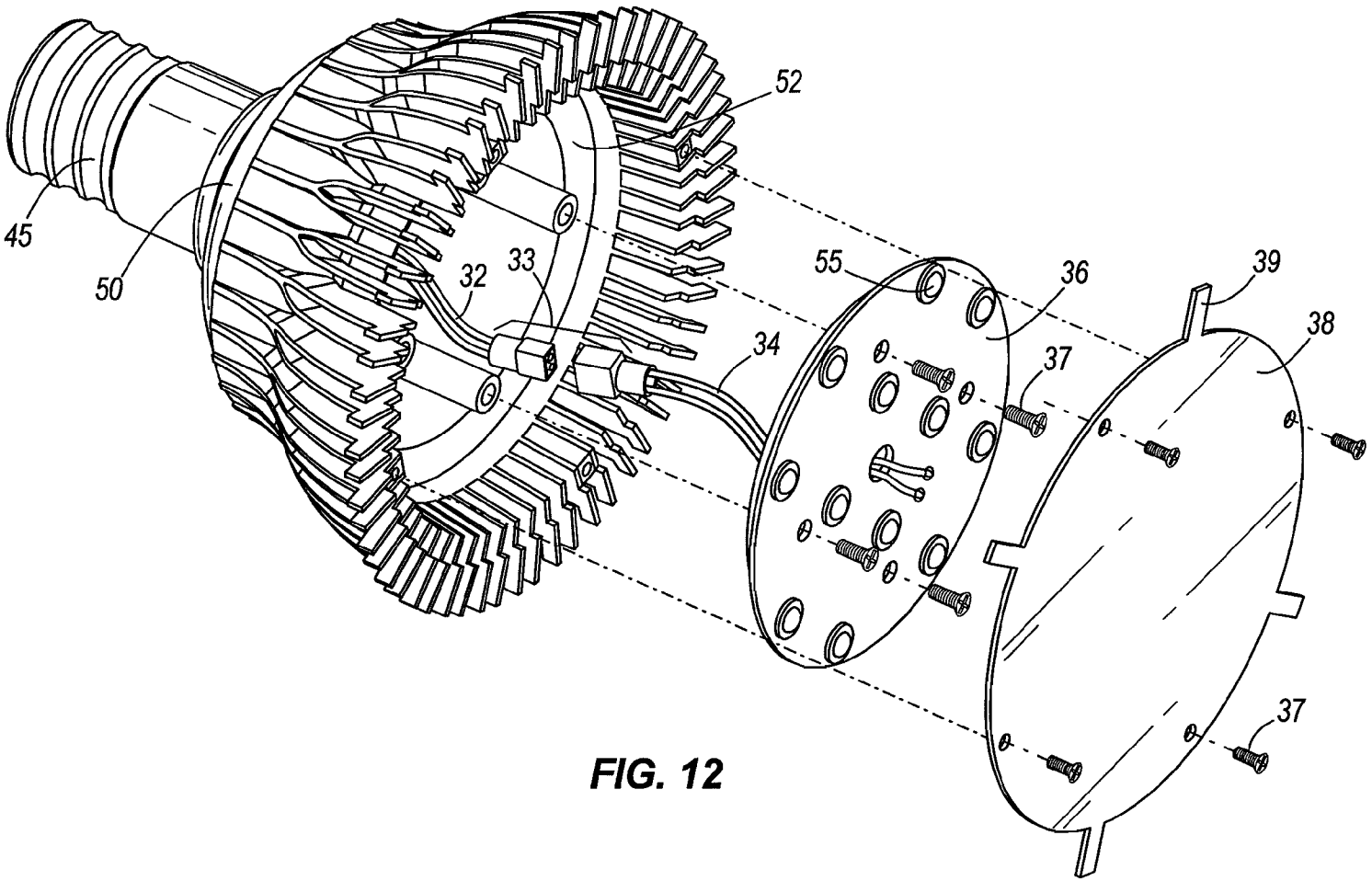
FIG. 12 is an exploded perspective view of the replacement bulb of FIG. 11.

FIGS. 11 and 12 illustrate yet another embodiment of replacement LED bulb 30*c* for use in the system of FIG. 2. The replacement bulb 30*c* includes an electrically-conductive base 45, a body 50 and a plurality of heat-dissipating fins 60 disposed about the body 50. The body 50 and fins 60 include a distal face 52 onto which an LED board 36 can be removably attached by means of fasteners 37. The distal face 52 is at the bulb end opposite the base 45. The base 45 of the replacement bulb 30*c* includes wires 32 that are attached to the base 45 and to a quick disconnect 33. The quick disconnect 33 is a male-female plug configuration having male and female plug components of conventional manufacture. The quick disconnect 33 is further attached to wires 34 that are, in turn, attached to the LED board 36. This forms a complete DC electric circuit between the base 45 and the LEDs 55 disposed on the board 36. This configuration provides for quick and easy removal and repair or replacement of the LED board 36 if such becomes necessary. The male-female components of the quick disconnect 33 can be disconnected when desired or required such that a new LED board 36 can be swapped out for the old LED board 36.

Further disposed atop the distal face 52 of the replacement bulb 30*c* is a non-metallic lens cover 38 that can be removably attached to the body 50 and fins 60 by means of fasteners 37. The lens cover 38 is preferably fabricated of a clear or frosted plastic material. The lens cover 38 of the replacement bulb 30*c* further includes a plurality of stand-off legs 39 that are disposed about the outer perimeter of the lens cover 38. When the replacement bulb 30*c* is secured within a canned lighting fixture (not shown), which fixture may comprise a generally round or conical metal construction, the stand-off legs 39 of the non-metallic lens cover 38 prevent inadvertent contact between the fixture sidewalls and the fins 60 of the replacement bulb 30*c*, which fins 60 are preferably fabricated of a metal material, such as aluminum, to aid in heat dissipation from the replacement bulb 30*c*.

It should also be mentioned that the replacement bulb 30*c* may be a parabolic aluminized reflector (PAR) lamp that includes the same plurality of LED elements 55 and a reflector (also not shown). The reflector reflects the light in the desired direction to produce the desired illumination pattern or to focus or spread the emitted light as desired. In the construction of the present invention, the lens 38 many be frosted to diffuse the light slightly or unfrosted.

To convert a preexisting MRI or other room 25 to use LED bulbs 30*a*, 30*b*, 30*c* as illustrated herein, a user first severs the electrical connection between the AC power source and the existing light sockets. The DC output of the DC lighting controller 35 is then connected to the existing light sockets using the pre-existing wiring. The DC lighting controller 35 is then connected to the AC power source 15 to provide AC power to the DC lighting controller 35. The incandescent light bulbs are removed from the sockets and are replaced by one of the replacement LED bulbs 30*a*, 30*b*, 30*c* illustrated herein or another suitable LED bulb. In some constructions, a computer 40 or other control device connects to the DC lighting controller 35 to control the DC power provided to the LED bulbs 30*a*, 30*b*, 30*c*.

In operation, AC power at standard voltage and frequency (e.g., 110 volt, 60 hz) is provided to the DC lighting controller 35. The DC lighting controller 35 converts the AC power to a DC voltage suitable for use with the LED elements 55. Typically, a transformer regulator and rectifier is employed to adjust the voltage to a level that results in a final DC voltage being suitable for use.

Thus, the invention provides, among other things, a lighting system 10*a* that uses LED bulbs 30*a*, 30*b*, 30*c* as replacements for incandescent bulbs in a room 25 that requires minimal EM noise.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

The principles of this invention being described in accordance with the foregoing, we claim as our invention the following:

1. An LED replacement bulb for use in an AC bulb socket, the AC bulb socket having been converted to a DC electric system, the bulb comprising:

an electrically-conductive base;

a body coupled with heat-dissipating fins, the body and fins having a distal portion relative to the base;

a lens cover that comprises a perimeter and a plurality of stand-off legs extending outwardly from the lens cover perimeter and is removably attached to the distal portion of the body and fins;

an LED board having a plurality of LEDs attached to the board and the board being removably attached to the distal portion of the body and fins;

an electrical connection between the base and the LED board; and an electrical quick disconnect disposed between the base and the LED board;

wherein the LED board can be removed and replaced with a like LED board via the quick disconnect.

2. The LED replacement bulb of claim 1 wherein the fins are constructed of a metal material to aid in heat dissipation from the bulb.

3. The LED replacement bulb of claim 2 wherein the metal material is aluminum.

4. The LED replacement bulb of claim 1 wherein the LED board is replaced by a plurality of LED bulbs disposed about the bulb body.

5. The LED replacement bulb of claim 4 wherein any one or more of the plurality of LED bulbs can be removed from the body without damaging the body.

6. An LED replacement bulb lighting system for use in a low EM room, the system comprising:

at least one DC bulb socket disposed within the low EM room;

a DC electrical source that provides DC electric power to the at least one bulb socket; and at least one LED replacement bulb that is removably received within the at least one DC bulb socket, the at least one LED replacement bulb further comprising:

an electronically-conductive base;

a body coupled with heat-dissipating fins, the body and fins having a distal portion relative to the base;

an LED board having a plurality of LEDs attached to the board and the board being removably attached to the distal portion of the body and fins;

an electrical connection between the base and the LED board;

an electrical quick disconnect disposed between the base and the LED board; and a lens cover that is removably attached to the distal portion of the body and fins;

wherein the lens cover of the at least one LED replacement bulb comprises a perimeter and a plurality of stand-off legs extending outwardly from the lens cover perimeter;

wherein the LED board can be removed and replaced with a like LED board via the quick disconnect; and wherein the at least one LED replacement bulb can be removed and replaced with a like LED replacement bulb.

7. The lighting system of claim 6 wherein the fins of the at least one LED replacement bulb are constructed of a metal material to aid in heat dissipation from the bulb.

8. The lighting system of claim 7 wherein the metal material is aluminum.

9. The lighting system of claim 6 wherein the LED board of the at least one LED replacement bulb is replaced by a plurality of LED bulbs disposed about the bulb body.

10. The lighting system of claim 9 wherein any one or more of the plurality of LED bulbs can be removed from the body without damaging the body.

* * * * *